US006203385B1

(12) United States Patent
Sato et al.

(10) Patent No.: US 6,203,385 B1
(45) Date of Patent: Mar. 20, 2001

(54) ELECTRICAL CONTACT

(75) Inventors: Naotoshi Sato; Masaya Yamamoto, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/556,477

(22) Filed: Apr. 21, 2000

(30) Foreign Application Priority Data

Apr. 27, 1999 (JP) ..... 11-119391

(51) Int. Cl.[7] ..... H01R 11/22
(52) U.S. Cl. ..... 439/852
(58) Field of Search ..... 439/852, 862, 439/876, 851, 856, 857, 858, 861

(56) References Cited

U.S. PATENT DOCUMENTS

| | | | | |
|---|---|---|---|---|
| 5,112,254 | * | 5/1992 | Endo | 439/852 |
| 5,281,175 | * | 1/1994 | Chupak et al. | 439/839 |
| 5,350,321 | * | 9/1994 | Takenouchi | 439/839 |
| 5,607,328 | * | 3/1997 | Joly | 439/852 |
| 5,707,259 | * | 1/1998 | Ishizuka et al. | 439/852 |
| 5,911,603 | * | 6/1999 | Mansutti | 439/748 |
| 5,971,816 | * | 10/1999 | Chaillot | 439/852 |
| 6,019,646 | * | 2/2000 | Okamura et al. | 439/852 |
| 6,042,433 | * | 3/2000 | Chen | 439/852 |

FOREIGN PATENT DOCUMENTS

| | | | | |
|---|---|---|---|---|
| 10-189102 | | 7/1998 | (JP) | H01R/13/11 |
| 98/29924 | | 7/1998 | (WO) | H01R/13/115 |

* cited by examiner

*Primary Examiner*—Renee Luebke
*Assistant Examiner*—Phuongchi Nguyen
(74) *Attorney, Agent, or Firm*—Sughrue, Mion, Zinn, Macpeak & Seas, PLLC

(57) ABSTRACT

An electrical contact portion (4) of an electrical contact includes a bottom wall (6), a pair of opposite side walls (7, 8) extending upright from the bottom wall (6), a top wall (9) extending from one of the side walls (7) and disposed in opposed relation to the bottom wall (6), and a reinforcing wall (10) formed integrally with the other one of the side walls (8) and partially covering the top wall (9). A vibration-absorbing plate (15) of a curved shape, which is formed at that end of the top wall (9) remote from a mating contact inserting-side, and has a resilient force set to a value smaller than a force of insertion of the mating contact into the interior of the electrical contact portion (4), so that the vibration-absorbing plate (15) can follow the mating contact during the insertion of the mating contact. A bifurcated-resilient contact piece (16) extends from the vibration-absorbing plate (15) into the interior of the electrical contact portion (4), and can be electrically connected to the mating contact. A stopper wall (20) which extends downwardly from that end of the reinforcing wall (10), remote from the mating contact inserting-side, toward the bottom wall (6) so as to prevent excessive displacement of the vibration-absorbing plate (15).

6 Claims, 7 Drawing Sheets

ELECTRICAL CONTACT

BACKGROUND OF THE INVENTION

1. Field of the Invention

The present invention relates to an electrical contact capable of absorbing vibrations during the electrical connection of this contact to a mating contact.

The present application is based on Japanese Patent Application No. Hei. 11-119391, which is incorporated herein by reference.

2. Description of the Related Art

When an electric connector, mounted in an automobile, is vibrated by an external force, fine sliding movements are liable to develop between an electrical contact in the electric connector and a mating contact electrically connected to this electrical contact. When such fine sliding movements develop, those surfaces (i.e., contact points) of the electrical contact and the mating contact, held in contact with each other, are worn. This results in a disadvantage that an electrical resistance at these contact surfaces increases.

Therefore, in order to reduce wear (i.e., friction) of the contact surfaces by absorbing fine sliding movements, an electrical contact 80, shown in FIG. 10, is disclosed by Unexamined Japanese Patent Publication No. Hei. 10-189102.

The electrical contact 80 includes an electrical contact portion 81 for receiving a mating contact (not shown) therein, and an electrical connection portion 82 for clamping a wire (not shown).

The electrical contact portion 81 has a square tubular shape, and includes an upper contact piece 84, supported by one side wall 87 in underlying relation to a top wall 83, and a resilient contact piece 86 which is connected to a rear end of the upper contact piece 86 through a resilient curved plate 85, and extends into the interior of electrical contact portion 81. The upper contact piece 84 is supported by the one side wall, and therefore can absorb upward and downward vibrations and right and left (that is, in directions perpendicular to the sheet of the drawing) vibrations at the time of insertion of the mating contact. However, the resilient contact piece 86 could not sufficiently absorbed vibrations in a direction (direction P) of insertion of the mating contact and in its opposite direction (direction Q).

Therefore, the present inventors of the present application have earlier proposed an electrical contact 90 as shown in FIG. 11, in U.S. patent application Ser. No. 09/456,834 filed on Dec. 7, 1999.

The electrical contact 90 includes a vibration-absorbing plate 93 of a curved shape, extending from a rear end of a top wall 92 of an electrical contact portion 91, and a bifurcated-resilient contact piece 94 which is formed integrally with the vibration-absorbing plate 93, and extends into the interior of the electrical contact portion 91. The vibration-absorbing plate 93 absorbs the vibration of the resilient contact piece 94 at the time of insertion of a mating contact, and therefore wear (i.e., friction) of the mating contact and the resilient contact piece due to fine sliding movement therebetween is reduced.

In the electrical contact 90, the vibration-absorbing plate 93 may be excessively displaced in a direction (i.e., direction P) of insertion of the mating contact and in its opposite direction (i.e., direction Q).

SUMMARY OF THE INVENTION

Therefore, the present inventors have further considered also concerning such a possibility that the vibration-absorbing plate 93 and the resilient contact piece 94 might be deformed due to the excessive displacement of the vibration-absorbing plate 93 in the worst case. Accordingly, it is an object of the present invention to provide an electrical contact in which a vibration-absorbing plate and a resilient contact piece are prevented from being excessively displaced in a direction of insertion of a mating contact and in its opposite direction.

To achieve the above object, according to the first aspect of the present invention, there is provided an electrical contact which comprises an electrical contact portion, into which a mating contact is insertable, having a square tubular shape, the electrical contact portion including a bottom wall, a pair of opposite side walls extending upright from the bottom wall, a top wall extending from one of the opposite side walls and disposed in opposed relation to the bottom wall, and a reinforcing wall formed integrally with the other one of the opposite side walls and partially covering the top wall, a vibration-absorbing plate extended from a portion of the top wall remote from a mating contact inserting-side, the vibration-absorbing plate having a curved shape and a resilient force set to a value smaller than a force of insertion of the mating contact into an interior of the electrical contact portion, so that the vibration-absorbing plate can follow the mating contact during the insertion of the mating contact, a bifurcated-resilient contact piece electrically connectable to the mating contact, the bifurcated-resilient contact piece being extended from the vibration-absorbing plate into the interior of the electrical contact portion, and a stopper wall extending downwardly from a portion of the reinforcing wall, remote from the mating contact inserting-side, toward the bottom wall so as to prevent excessive displacement of the vibration-absorbing plate.

Accordingly, since the resilient force of the vibration-absorbing plate is set to a value smaller than the force of insertion of the mating contact into the interior of the electrical contact portion, the vibration-absorbing plate is resiliently deformed in accordance with the movement of the mating contact during the insertion thereof. At this time, the vibration-absorbing plate and the bifurcated-resilient contact piece move together with the mating contact in the direction of movement of the mating contact. The vibration-absorbing plate, thus following the mating contact, abuts against the stopper wall, and therefore the bifurcated-resilient contact piece will not be excessively displaced in the direction of insertion of the mating contact.

Further, according to the second aspect of the present invention, it is preferable that the bifurcated-resilient contact piece includes a pair of first and second resilient contact pieces, and a pair of openings are formed respectively through at least two of the walls of the electrical contact portion opposed respectively to distal end portions of the pair of first and second resilient contact pieces, and the resilient force of the vibration-absorbing plate is set to a value smaller than a force of withdrawal of the mating contact from the electrical contact portion after connection with the mating contact, so that the distal end portions of the pair of first and second resilient contact pieces can abut respectively against edges of the pair of openings when following the mating contact during the withdrawal of the mating contact.

In accordance with the second aspect of the present invention, during the withdrawal of the mating contact, the bifurcated-resilient contact piece and the vibration-absorbing plate move in accordance with the movement of the mating contact. The distal end portions of the bifurcated-resilient contact piece abut respectively against the edges of the openings, and therefore the bifurcated-resilient contact piece will not be excessively displaced in the direction of disengagement of the mating contact.

Further, according to the third aspect of the present invention, it is preferable that the bifurcated-resilient contact piece further includes an interconnecting plate interconnecting the first resilient contact piece to the second resilient contact piece, and the first resilient contact piece extends from the vibration-absorbing plate, and the second resilient contact piece opposes to the first resilient contact piece.

Further, according to the fourth aspect of the present invention, it is preferable that the electrical-contact further comprises contact point portions respectively formed on the pair of first and second resilient contact pieces to define distal end portions of the pair of first and second resilient contact pieces.

Further, according to the fifth aspect of the present invention, it is preferable that the pair of first and second resilient contact pieces gradually approaches each other toward the contact point portions thereof, and are bent at the respective contact point portions so that the distal end portions of the pair of first and second resilient contact pieces are extended in different directions away from each other.

Further, according to the sixth aspect of the present invention, it is preferable that the contact point portions are brought into electrical contact with the mating contact when the mating contact is inserted into the electrical contact portion.

DETAILED DESCRIPTION OF THE PREFERRED EMBODIMENT

A preferred embodiment of the present invention will now be described with reference to FIGS. 1 to 9. FIGS. 1 to 9 show one preferred embodiment of an electrical contact of the present invention.

Figure 1:
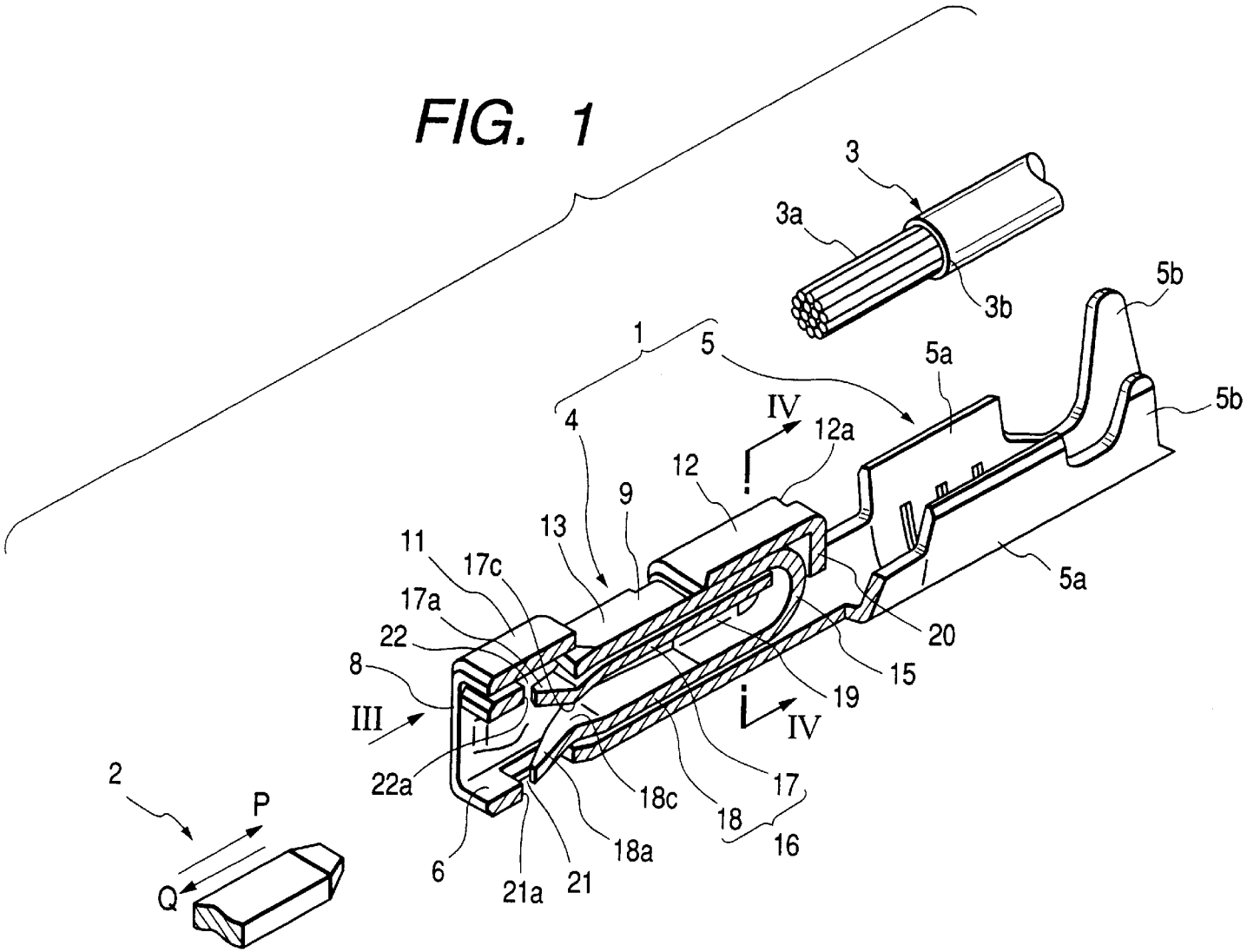
FIG. 1 is a perspective view showing the whole of one preferred embodiment of an electrical contact of the present invention.

As shown in FIG. 1, this electrical contact 1 includes an electrical contact portion 4, into which a mating contact 2 can be inserted to be electrically connected thereto, and a wire connection portion 5 to which a wire 3 can be connected. In this embodiment, the electrical contact 1 is of the female type while the mating contact 2 is of the male type.

The electrical contact portion 4 is formed into a square tubular shape.

Figure 2:
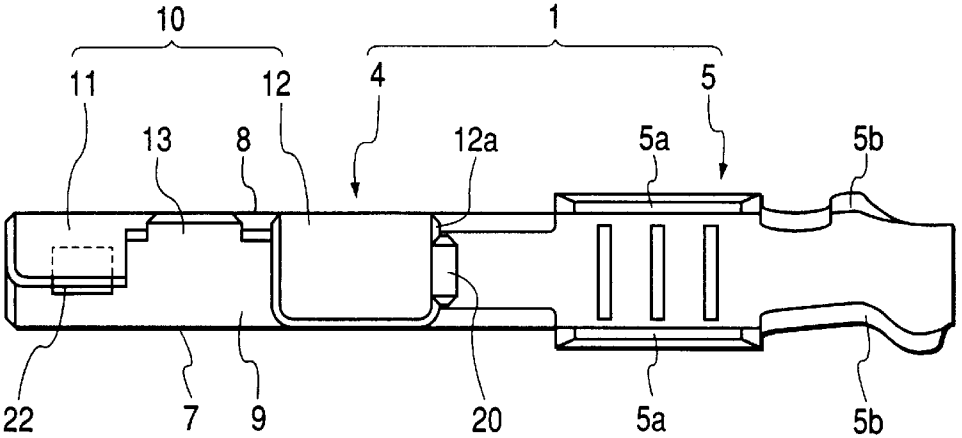
FIG. 2 is a top plan view of the electrical contact of FIG. 1.

More specifically, as shown in FIGS. 1 and 2, the electrical contact portion 4 includes a bottom wall 6, a pair of opposite side walls 7 and 8, extending upright respectively from opposite side edges of the bottom wall 6, a top wall 9, extending from one side wall 7 and disposed in opposed relation to the bottom wall 6, and a reinforcing wall 10 formed integrally with the other side wall 8 and partially covering the top wall 9.

A retaining wall 13 extends from that side edge of the top wall 9, disposed adjacent to the other side wall 8, at a lengthwise-central portion thereof. A retaining groove (not shown) for the retaining wall 13 is formed in an upper end of the other side wall 8 at a lengthwise-central portion thereof. The retaining wall 13 is retainingly engaged in the retaining groove, thereby positioning the top wall 9 relative to the other side wall 8.

Figure 4:
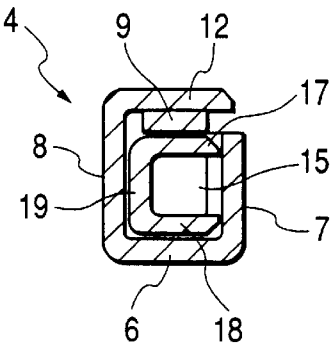
FIG. 4 is a cross-sectional view taken along the line IV—IV of FIG. 1.
Figure 3:
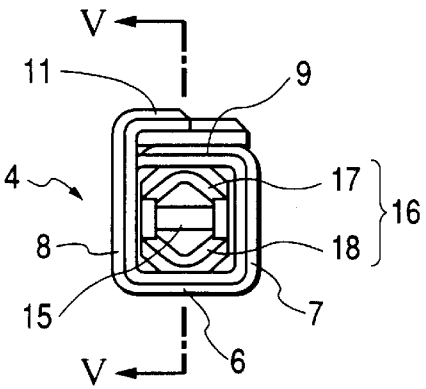
FIG. 3 is a view as seen in a direction of arrow III of FIG. 1.

As shown in FIGS. 2 to 4, the reinforcing wall 10 includes a front reinforcing wall 11, extending from a front end portion of the other side wall 8, and a rear reinforcing wall 12 formed integrally with a rear end portion of the other side wall 8. The front reinforcing wall 11 partially covers a front end portion of the top wall 9, and the rear reinforcing wall 12 completely covers a rear end portion of the top wall 9. The reinforcing wall 10 covers the top wall 9, thereby preventing the top wall 9 from being lifted or raised. There can be used an arrangement in which two retaining walls 13 are formed integrally with the opposite end portions of the top wall 9, respectively, and a reinforcing wall 10 extends from a central portion of the other side wall 8.

As shown in FIGS. 1 to 5, a vibration-absorbing plate 15 of a curved shape is formed integrally with the top wall 9 at the rear end thereof remote from the mating contact inserting-side. The vibration-absorbing plate 15 has resiliency, and therefore can be resiliently deformed and moved in accordance with the insertion and withdrawal (disengagement) of the mating contact 2.

Figure 5:
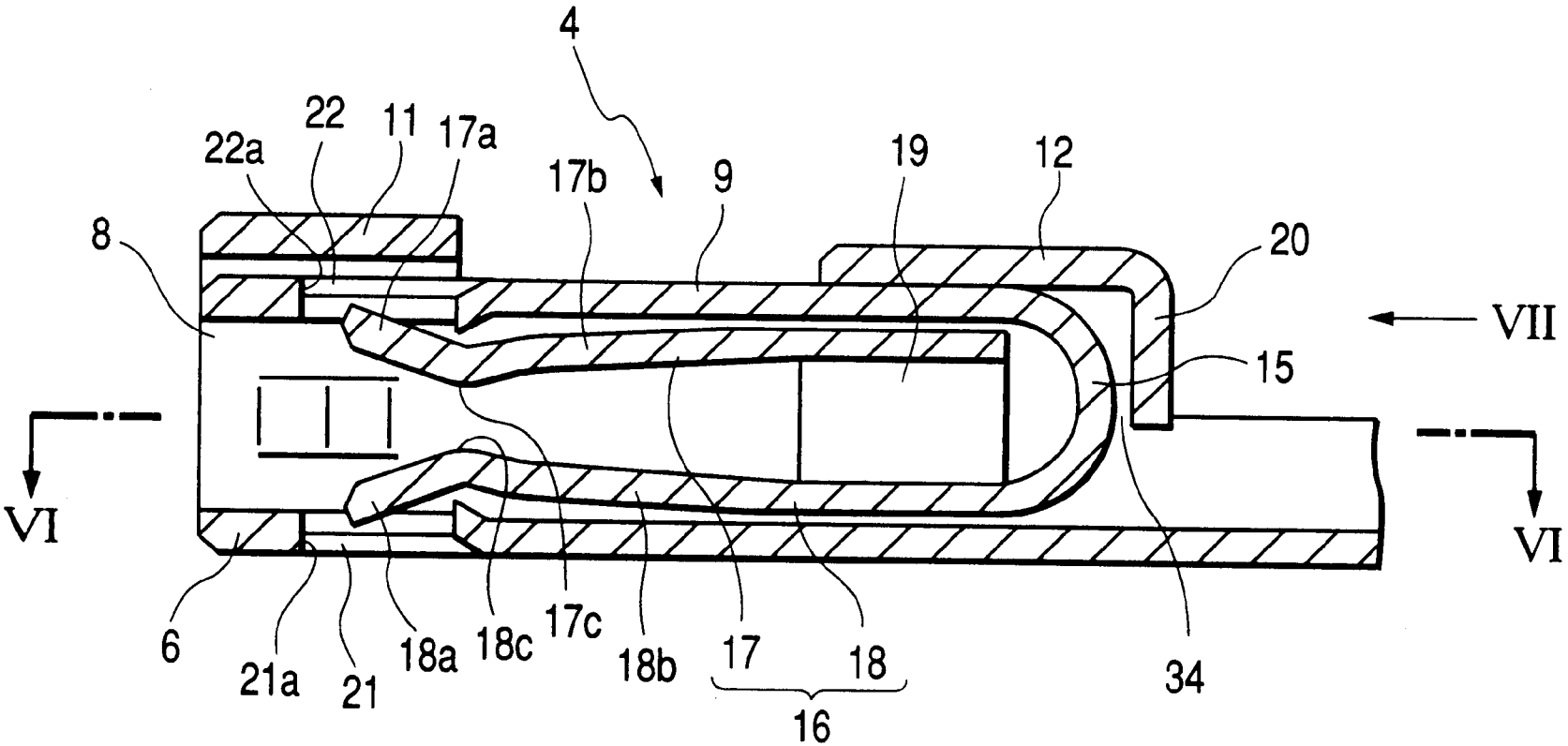
FIG. 5 is a cross-sectional view taken along the line V—V of FIG. 3.
Figure 6:
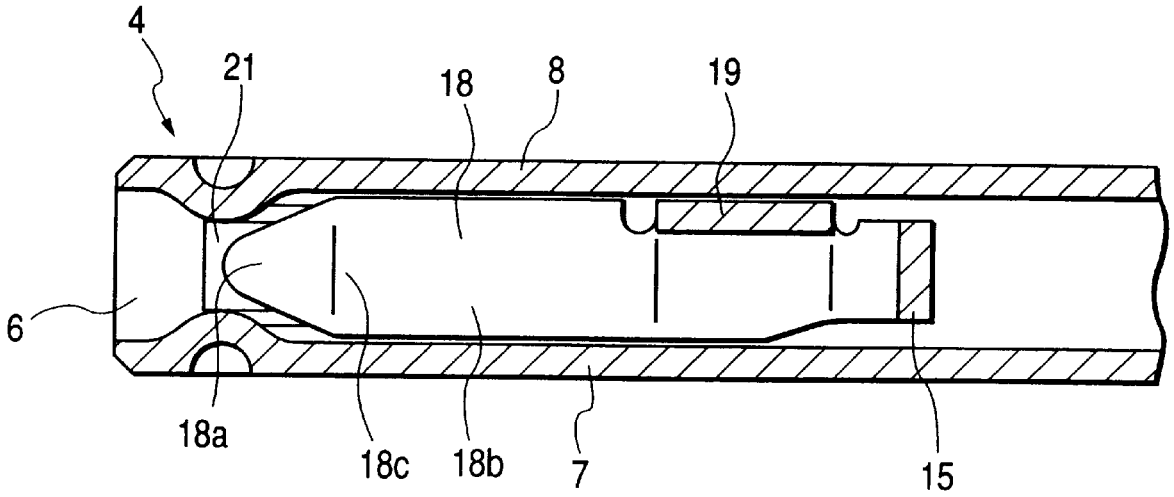
FIG. 6 is a cross-sectional view taken along the line VI—VI of FIG. 5.

As shown in FIGS. 1, 5 and 6, a bifurcated-resilient contact piece 16 extends from the vibration-absorbing plate 15. The resilient contact piece 16 includes a lower resilient contact piece 18, connected to the vibration-absorbing plate 15, an upper resilient contact piece 17, disposed in opposed relation to the lower resilient contact piece 18, and an interconnecting plate 19 interconnecting the upper and lower resilient contact pieces 17 and 18. The upper resilient contact piece 17 is opposed to the top wall 9, and the lower resilient contact piece 18 is opposed to the bottom wall 6. That portion of the upper resilient contact piece 17, lying between its distal end 17*a* and its intermediate portion 17*b*, and that portion of the lower resilient contact piece 18, lying between its distal end 18*a* and its intermediate portion 18*b*, are turned (or bent) away from each other. Namely, the upper resilient contact piece 17 is once bent downward, and then is bent upward whereas the lower resilient contact piece 18 is once bent upward, and then is bent downward.

As shown in FIGS. 5 and 6, the interconnecting plate 19 is generally parallel to the one side wall 7, and is connected to side edges of the upper and lower resilient contact pieces 17 and 18.

Figure 7:
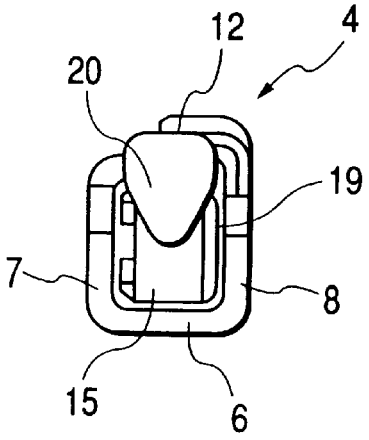
FIG. 7 is a view as seen in a direction of arrow VII of FIG. 5.

As shown in FIGS. 1, 5 and 7, a stopper wall 20 extends downwardly from a rear end 12*a* of the rear reinforcing wall 12 toward the bottom wall 6. The angle between the rear reinforcing wall 12 and the stopper wall 20 is substantially 90 degrees.

As shown in FIGS. 1 and 5, holes 21 and 22 of a rectangular shape are formed respectively through the front end potions (the mating contact inserting-side) of the bottom and top walls 6 and 9. As a result of formation of the holes 21 and 22, the distal end portions 17*a* and 18*a* of the upper and lower resilient contact pieces 17 and 18 can escape respectively into the holes 22 and 21 when the mating contact 2 is inserted. Therefore, the distal end portion 17*a* of the upper resilient contact piece 17 can be abutted against a peripheral edge 22*a* of the opening 22, thereby preventing excessive displacement of the upper resilient contact piece 17. Similarly, excessive displacement of the lower resilient contact piece 18 is prevented by a peripheral edge 21*a* of the hole 21.

In the production of the electrical contacts 1, by blanking (stamping) an electrically-conductive sheet material, a plurality of electrical contact-like flat sheets (not shown) are formed continuously on an interconnecting strip (not shown), and these electrical contact-like flat sheets are pressed, and then the interconnecting strip is cut and removed.

Referring back to FIG. 1, the wire connection portion 5 includes a pair of conductor clamping piece portions 5*a* and 5*a* for clamping a conductor 3*a* of the wire 3, and a pair of sheath clamping piece portions 5*b* and 5*b* for clamping an insulating sheath 3*b* of the wire 3.

Next, description will be made of how excessive displacement of the vibration-absorbing plate 15 and the resilient contact piece 16 is prevented when inserting the mating contact 2 into the electrical contact 1 and when withdrawing the mating contact 2 from the electrical contact 1. Actually, a plurality of mating contacts 2 are connected to a plurality of electrical contacts 1, respectively. However, in this embodiment, explanation will be made of the case where one electrical contact 1 and one mating contact 2 are connected together.

Figure 9:
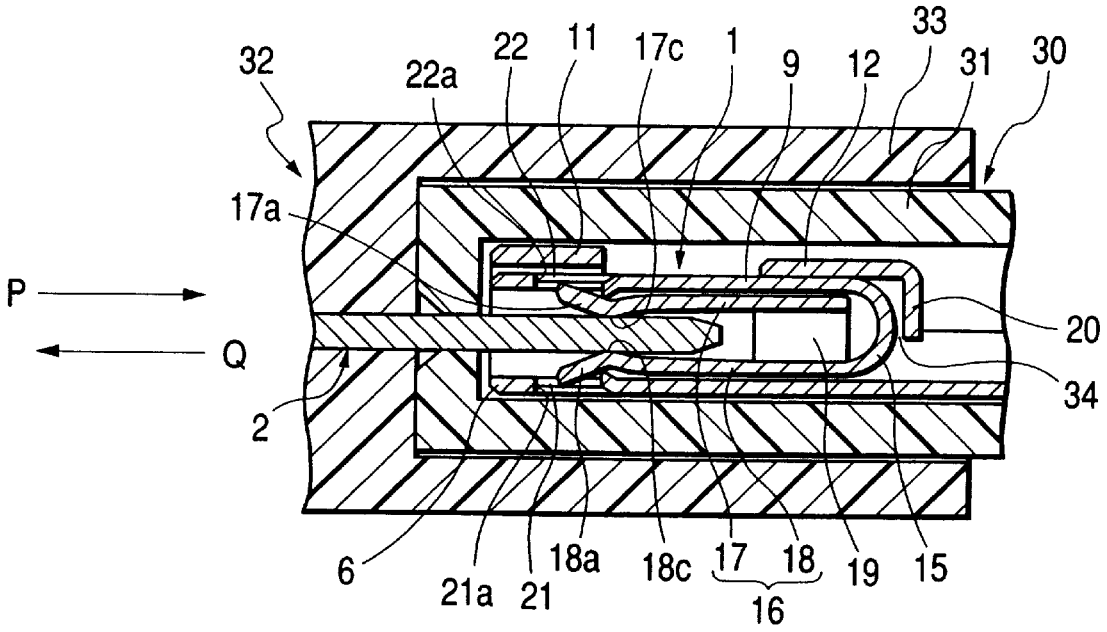
FIG. 9 is a cross-sectional view showing the male connector and the female connector of FIG. 8 in a mutually-fitted condition.
Figure 10:
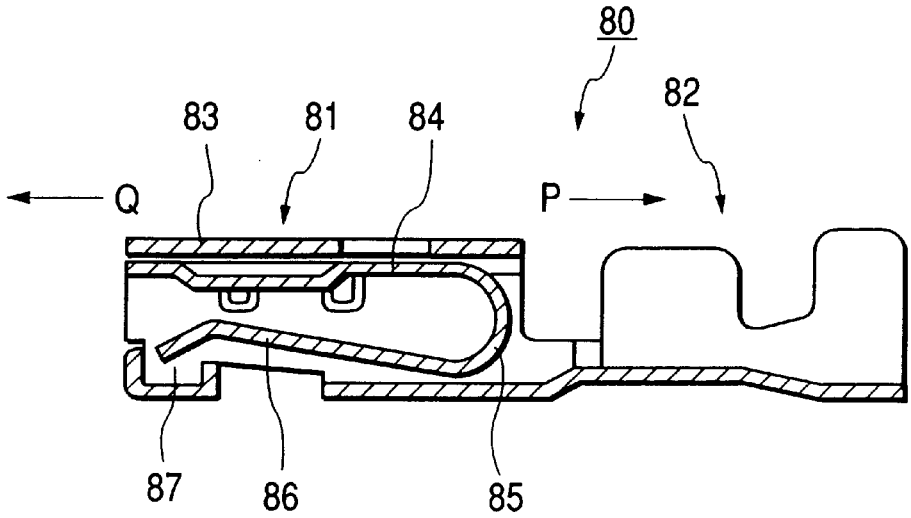
FIG. 10 PRIOR ART
FIG. 10 is a cross-sectional view of an electrical contact of the related construction.
Figure 11:
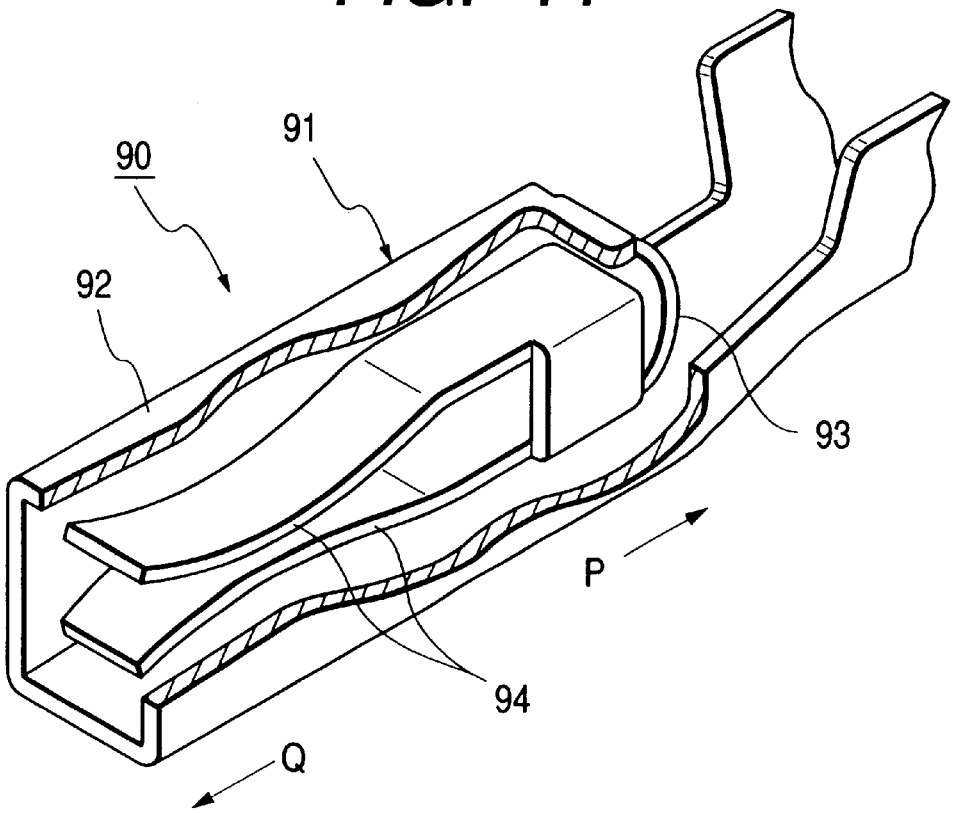
FIG. 11 is a perspective view of another electrical contact of the related construction.

As shown in FIG. 9, the electrical contact 1 is inserted into a male connector housing 31 to provide a male connector 30. Similarly, the mating contact 2 is inserted into a female connector housing 33 to provide a female connector 32. Within the male connector 30, a gap 34 is formed between the vibration-absorbing plate 15 and the stopper wall 20 of the electrical contact 1.

Fitting of the male and female connectors 30 and 32 will now be described below.

Figure 8:
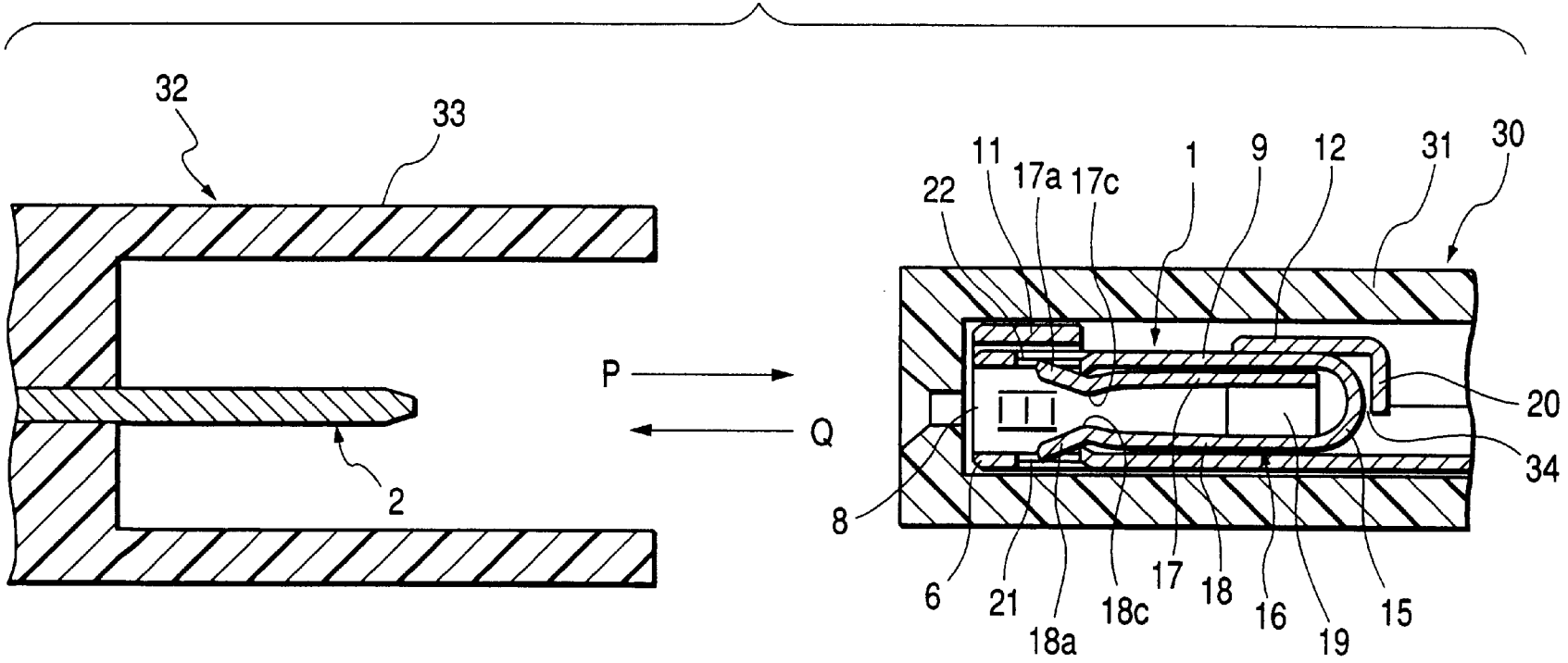
FIG. 8 is a cross-sectional view showing a male connector, formed by inserting the electrical contact of FIG. 1 into a male connector housing, and a female connector formed by inserting a mating contact into a female connector housing.

When the male connector 30 is inserted into the female connector 32 (or the female connector 32 is fitted on the male connector 30) as shown in FIGS. 1 and 8, the mating contact 2 is inserted between the upper and lower resilient contact pieces 17 and 18 through a gap between their distal end portions 17*a* and 18*a*. At this time, the upper and lower resilient contact pieces 17 and 18 are resiliently deformed to be moved away from each other as the mating contact 2 slides over contact points 17*c* and 18*c* of the upper and lower resilient contact pieces 17 and 18. The resilient contact piece 16 and the vibration-absorbing plate 15 are moved backward (that is, in the direction P of insertion of the mating contact 2) in accordance with the insertion of the mating contact 2, so that the gap 34 is narrowed. At this time, the vibration-absorbing plate 15 is gradually resiliently deformed. The resilient contact piece 16 is moved (displaced) in accordance with the insertion of the mating contact 2, and therefore the resilient force (spring force) of the vibration-absorbing plate 15 is set to a value smaller than the force of insertion of the mating contact 2 into the electrical contact portion 4.

In the case where the vibration-absorbing plate 15 abuts against the stopper wall 20 before the two connectors are fitted together, the mating contact 2 is inserted between the upper and lower resilient contact pieces 17 and 18 in this abutted condition. Therefore, excessive displacement of the vibration-absorbing plate 15 can be prevented at the time of insertion of the mating contact 2. Therefore, the mating contact 2 can be brought into stable electrical contact with the electrical contact 1. In other case, the vibration-absorbing plate 15 does not abut against the stopper wall 20, and therefore the resilient contact piece 16 is not excessively displaced. After the fitting connection is effected, the vibration-absorbing plate 15 is kept resiliently deformed.

Disengagement of the mutually-fitted female and male connectors 32 and 30 will now be described below.

As the male connector 30 is withdrawn from the female connector 32 as shown in FIGS. 1 and 9, the mating contact 2 is withdrawn from the electrical contact 1, and is moved backward, that is, in the direction Q of disengagement of the mating contact 2. The mating contact 2 slides over the contact points 17*c* and 18*c* of the upper and lower resilient contact pieces 17 and 18. At this time, during the time when the resilient force (spring force) of the resiliently-deformed vibration-absorbing plate 15 is larger than the force (withdrawing force) of withdrawal of the mating contact 2 from the electrical contact 1, the resilient contact piece 16 advances together with the mating contact 2 in the direction Q in accordance with the backward movement of the mating contact 2. The distal end portions 17*a* and 18*a* of the resilient contact piece 16, thus following the mating contact, abut respectively against the peripheral edges 22*a* and 21*a* of the holes 22 and 21 formed respectively through the top wall 9 and the bottom wall 6. Therefore, the excessive displacement of the resilient contact piece 16 is prevented.

As the vibration-absorbing plate 15 is gradually restored into its natural condition, the resilient force of the vibration-absorbing plate 15 decreases (or becomes smaller). Therefore, when the mating contact 2 is withdrawn to a certain degree, the resilient force and the withdrawing force become equal to each other. At this time, the resilient contact piece 16 becomes stationary relative to the mating contact 2.

When the resilient force becomes smaller than the withdrawing force, the resilient contact piece 16 ceases to follow the mating contact 2, moving backward (in the direction Q), and is stopped, and the mating contact 2 continues to slide over the contact points 17*c* and 18*c* of the upper and lower resilient contact pieces 17 and 18. This sliding movement prevents fine vibrations from developing in the electrical contact 1, and therefore a predetermined load is applied to the upper and lower resilient contact pieces 17 and 18. Therefore, an oxide film on the surface of the mating contact 2 is shaved, thereby suppressing the increase of an electrical resistance at the area of contact between the electrical contact 1 and the mating contact 2.

As described above, when inserting the mating contact 2 into the electrical contact 1 as shown in FIGS. 8 and 9, the vibration-absorbing plate 15 is abutted against the stopper wall 20, thereby preventing excessive displacement of the vibration-absorbing plate 15 and the resilient contact piece 16 in the direction P. When withdrawing the mating contact 2 from the electrical contact 1, the distal end portions 17*c* and 18*c* of the upper and lower resilient contact pieces 17 and 18 are abutted respectively against the edges of the openings 22 and 21, formed respectively in the upper and lower walls 9 and 6, thereby preventing excessive displacement of the vibration-absorbing plate 15 and the resilient contact piece 16 in the direction Q. Therefore, during the inserting and withdrawing operations, fine-sliding-movement wear (i.e., friction) between each contact point 17*c*, 18*c* of the electrical contact 1 and the mating contact 2 can be reduced.

As described above, in the present invention, the bifurcated-resilient contact piece, provided within the electrical contact portion, is connected to the vibration-absorbing plate. The resilient force of the vibration-absorbing plate is set to a value smaller than the force of insertion of the mating contact into the electrical contact portion. Therefore, when the mating contact is inserted, the bifurcated-resilient contact piece and the vibration-absorbing plate move in accordance with the movement of the mating contact. Therefore, fine-sliding-movement wear (i.e., friction) between the mating contact and the resilient contact piece can be reduced.

The stopper wall extends downwardly from the reinforcing wall toward the bottom wall, and therefore the vibration-absorbing plate, following the mating contact, abuts against the stopper wall. Thus, the stopper wall can limit the movement of the vibration-absorbing plate in the direction of insertion of the mating contact. Therefore, the vibration-absorbing plate and the resilient contact piece are prevented from being excessively displaced in the direction of insertion of the mating contact.

The vibration-absorbing plate thus abuts against the stopper wall, and in this abutted condition, the mating contact can be positively electrically connected to the resilient contact piece. Therefore, the stable connection between the mating contact and the resilient contact piece can be achieved.

In the present invention, the resilient force of the vibration-absorbing plate is set to a value smaller than the force of withdrawal of the mating contact from the electrical contact portion after the connection. Therefore, during the withdrawal of the mating contact, the vibration-absorbing plate and the bifurcated-resilient contact piece move in the withdrawing direction in accordance with the movement of the mating contact. Therefore, fine-sliding-movement wear (i.e., friction) between the resilient contact piece and the mating contact is prevented.

The openings are formed respectively in the walls opposed respectively to the distal end portions of the bifurcated-resilient contact piece, and therefore the distal end portions of the resilient contact piece, following the mating contact, abut respectively against the edges of the openings. Namely, the movement of the resilient contact piece and the vibration-absorbing plate can be limited. Therefore, the resilient contact piece and the vibration-absorbing plate are prevented from being excessively displaced in the withdrawing direction.

What as claimed is:

1. An electrical contact, comprising:

an electrical contact portion, into which a mating contact is insertable, having a square tubular shape, the electrical contact portion including a bottom wall, a pair of opposite side walls extending upright from the bottom wall, a top wall extending from one of the opposite side walls and disposed in opposed relation to the bottom wall, and a reinforcing wall formed integrally with the other one of the opposite side walls and partially covering the top wall;

a vibration-absorbing plate extended from a portion of the top wall remote from a mating contact inserting-side, the vibration-absorbing plate having a curved shape and a resilient force set to a value smaller than a force of insertion of the mating contact into an interior of the electrical contact portion, so that the vibration-absorbing plate can follow the mating contact during the insertion of the mating contact;

a bifurcated-resilient contact piece electrically connectable to the mating contact, the bifurcated-resilient contact piece being extended from the vibration-absorbing plate into the interior of the electrical contact portion; and a stopper wall extending downwardly from a portion of the reinforcing wall, remote from the mating contact inserting-side, toward the bottom wall so as to prevent excessive displacement of the vibration-absorbing plate.

2. The electrical contact of claim 1, wherein the bifurcated-resilient contact piece includes a pair of first and second resilient contact pieces, and wherein a pair of openings are formed respectively through at least two of the walls of the electrical contact portion opposed respectively to distal end portions of the pair of first and second resilient contact pieces, and the resilient force of the vibration-absorbing plate is set to a value smaller than a force of withdrawal of the mating contact from the electrical contact portion after connection with the mating contact, so that the distal end portions of the pair of first and second resilient contact pieces can abut respectively against edges of the pair of openings when following the mating contact during the withdrawal of the mating contact.

3. The electrical contact of claim 1, wherein the bifurcated-resilient contact piece includes a pair of first and second resilient contact pieces and an interconnecting plate interconnecting the first resilient contact piece to the second resilient contact piece, the first resilient contact piece extends from the vibration-absorbing plate, the second resilient contact piece opposes to the first resilient contact piece.

4. The electrical contact of claim 3, further comprising contact point portions respectively formed on the pair of first and second resilient contact pieces to define distal end portions of the pair of first and second resilient contact pieces.

5. The electrical contact of claim 4, wherein the pair of first and second resilient contact pieces gradually approaches each other toward the contact point portions thereof, and are bent at the respective contact point portions so that the distal end portions of the pair of first and second resilient contact pieces are extended in different directions away from each other.

6. The electrical contact of claim 4, wherein the contact point portions are brought into electrical contact with the mating contact when the mating contact is inserted into the electrical contact portion.

* * * * *